US008188942B2

(12) United States Patent
Yoo et al.

(10) Patent No.: US 8,188,942 B2
(45) Date of Patent: May 29, 2012

(54) LIGHT EMITTING DEVICE

(75) Inventors: Donghee Yoo, Seoul (KR); Hongseok Choi, Seoul (KR); Woochan Kim, Seoul (KR); Hwakyung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 956 days.

(21) Appl. No.: 12/014,962

(22) Filed: Jan. 16, 2008

(65) Prior Publication Data

US 2008/0218090 A1 Sep. 11, 2008

(30) Foreign Application Priority Data

Mar. 8, 2007 (KR) ..... 10-2007-0023220
Mar. 8, 2007 (KR) ..... 10-2007-0023222

(51) Int. Cl.
*G09G 3/30* (2006.01)

(52) U.S. Cl. ..... 345/76; 315/169.3; 315/169.4

(58) Field of Classification Search .... 315/169.3–169.4; 345/76–84

See application file for complete search history.

(56) References Cited

U.S. PATENT DOCUMENTS

| | | | | |
|---|---|---|---|---|
| 2004/0263445 | A1* | 12/2004 | Inukai et al. | 345/82 |
| 2005/0139841 | A1* | 6/2005 | Park | 257/79 |
| 2005/0173700 | A1* | 8/2005 | Liao et al. | 257/40 |
| 2006/0001792 | A1* | 1/2006 | Choi | 349/54 |

FOREIGN PATENT DOCUMENTS

| | | | |
|---|---|---|---|
| JP | 2004-341216 | A | 12/2004 |
| JP | 2005-338658 | A | 12/2005 |
| KR | 10-2002-0094905 | A | 12/2002 |
| WO | WO 2006/118440 | A1 | 11/2006 |

OTHER PUBLICATIONS

Korean Decision to Grant a Patent dated Feb. 2, 2009 for Application No. 102007-0023320.

Korean Decision to Grant a Patent dated Feb. 2, 2009 for Application No. 102007-0023322.

* cited by examiner

*Primary Examiner* — Alexander Eisen
*Assistant Examiner* — Robin Mishler
(74) *Attorney, Agent, or Firm* — KED & Associates, LLP

(57) ABSTRACT

A light emitting device is disclosed. The light emitting device includes a substrate, a display unit that is positioned on the substrate and includes a plurality of subpixels, signal lines on the substrate, a pad unit positioned at either edge of the substrate, and a dummy pad unit positioned at both sides of the pad unit outside the pad unit on the signal lines. The signal lines include scan lines, power supply lines, and ground lines which are connected to the plurality of subpixels. The pad unit includes a driver supplying driving signals to the signal lines. The dummy pad unit is connected to the signal lines.

27 Claims, 11 Drawing Sheets

LIGHT EMITTING DEVICE

This application claims the benefit of Korean Patent Application Nos. 10-2007-0023220 and 10-2007-0023222 filed on Mar. 8, 2007, which is hereby incorporated by reference.

BACKGROUND

1. Field

An exemplary embodiment relates to a light emitting device.

2. Description of the Related Art

A light emitting device is a self-emitting device including a light emitting layer between two electrodes. The light emitting device may be classified into an inorganic light emitting device and an organic light emitting device depending on a material of the light emitting layer.

The organic light emitting device forms an exciton, which is a hole-electron pair, by combining holes received from an anode electrode and electrons received from a cathode electrode inside an organic light emitting layer, and emits light by energy generated when the exciton returns from an excited state to a ground state.

The organic light emitting device may be classified into a passive matrix type organic light emitting device and an active matrix type organic light emitting device depending on a driving manner.

The active matrix organic light emitting device has a low power consumption and small crosstalk between pixels as compared with the passive matrix organic light emitting device, and thus can be suitable for a large-sized display device or a high-definition display device. The active matrix organic light emitting device generally includes at least one subpixel at each of intersections of N scan lines and M data lines that are arranged in a matrix format on a substrate. The subpixel includes at least one thin film transistor, a capacitor, and an organic light emitting diode.

The thin film transistor includes a source electrode, a drain electrode, and a gate electrode. The organic light emitting diode is electrically connected to the source electrode or the drain electrode of the thin film transistor. The thin film transistor may be classified into a switching thin film transistor and a driving thin film transistor. The switching thin film transistor or the driving thin film transistor may include a compensation circuit depending on their properties.

In the organic light emitting device, when the switching thin film transistor is turned on by a scan signal supplied through the scan line, the capacitor stores a data signal supplied through the data line a data voltage form. The data voltage stored in the capacitor turns on a gate of the driving thin film transistor, and thus the organic light emitting diode can emit light.

The organic light emitting device includes an aging pad at an edge of a driving device that is positioned on the substrate to supply the data signal and the scan signal, and performs an aging process using the aging pad. However, the related art aging pad has a structural demerit (for example, a reduction or a drop in a current due to a resistance, i.e., IR drop) that cannot uniformly perform the aging process.

SUMMARY

An exemplary embodiment provides a light emitting device capable of improving the display quality by uniformly performing an aging process.

In one aspect, a light emitting device comprises a substrate, a display unit on the substrate, the display unit including a plurality of subpixels, signal lines on the substrate, the signal lines including scan lines, power supply lines, and ground lines which are connected to the plurality of subpixels, a pad unit positioned at either edge of the substrate, the pad unit including a driver supplying driving signals to the signal lines, and a dummy pad unit positioned at both sides of the pad unit outside the pad unit on the signal lines, the dummy pad unit being connected to the signal lines.

In another aspect, a light emitting device comprises a substrate, a display unit on the substrate, the display unit including a plurality of subpixels, a plurality of monitor pixels positioned outside the display unit, signal lines on the substrate, the signal lines including scan lines, power supply lines, and ground lines which are connected to the plurality of subpixels and the plurality of monitor pixels, a pad unit positioned at either edge of the substrate, the pad unit including a driver supplying driving signals to the signal lines, a first dummy pad unit positioned at both sides of the pad unit outside the pad unit on the signal lines, the first dummy pad unit being connected to the signal lines connected to the subpixels and the signal lines connected to the monitor pixels, and a second dummy pad unit positioned inside the pad unit, the second dummy pad unit being connected to the signal lines connected to the monitor pixel.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION

Reference will now be made in detail embodiments of the invention examples of which are illustrated in the accompanying drawings.

Figure 1:
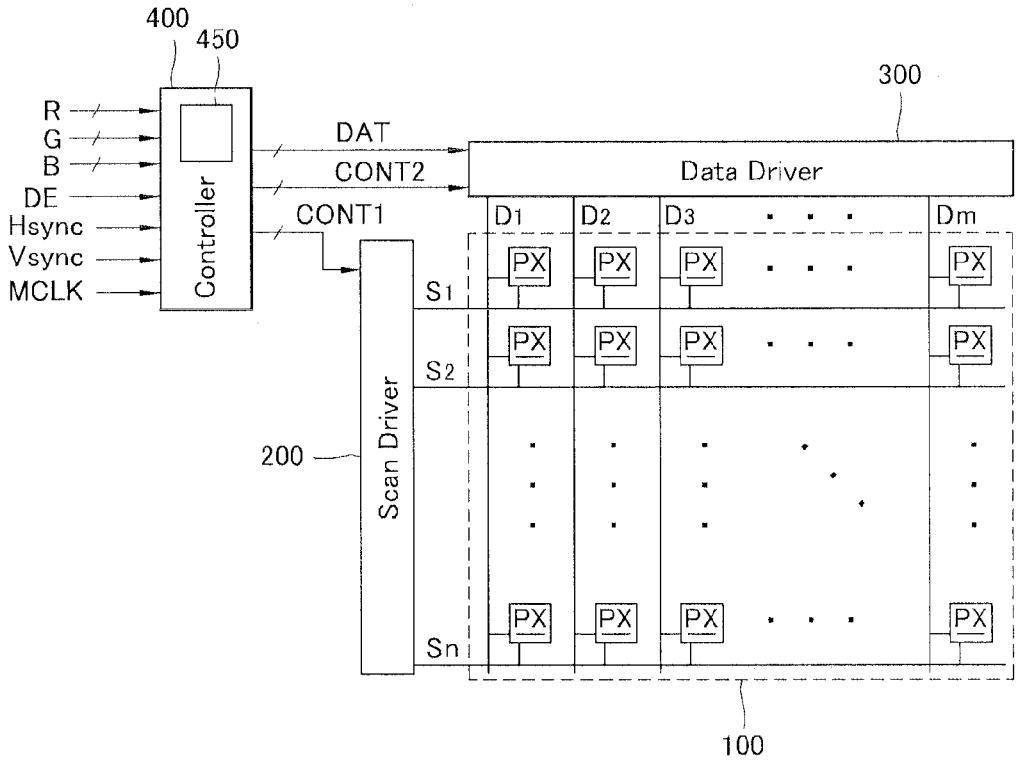
FIG. 1 is a bock diagram of a light emitting device according to an exemplary embodiment.
Figure 2:
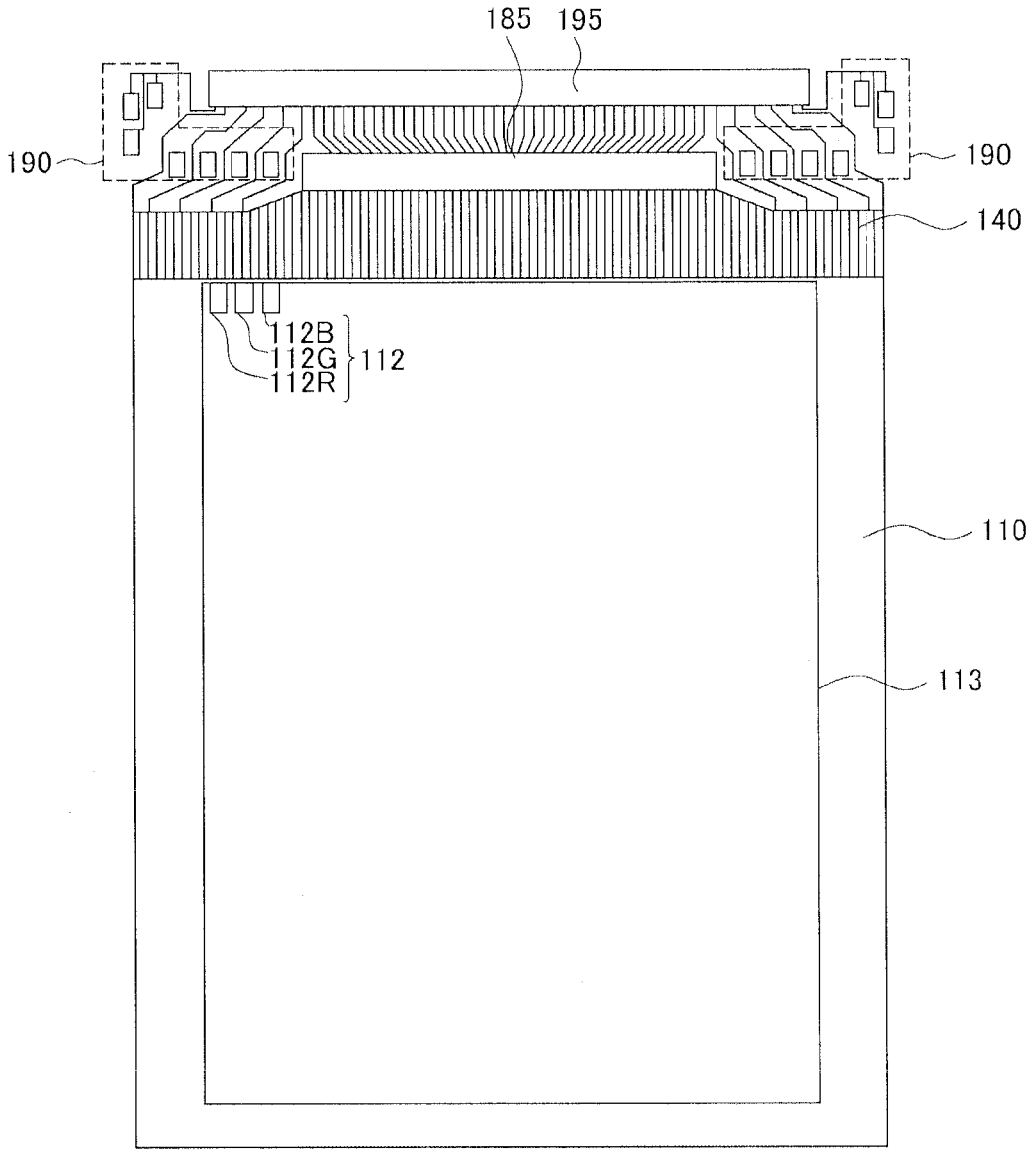
FIG. 2 is a schematic plane view of the light emitting device.
Figure 3:
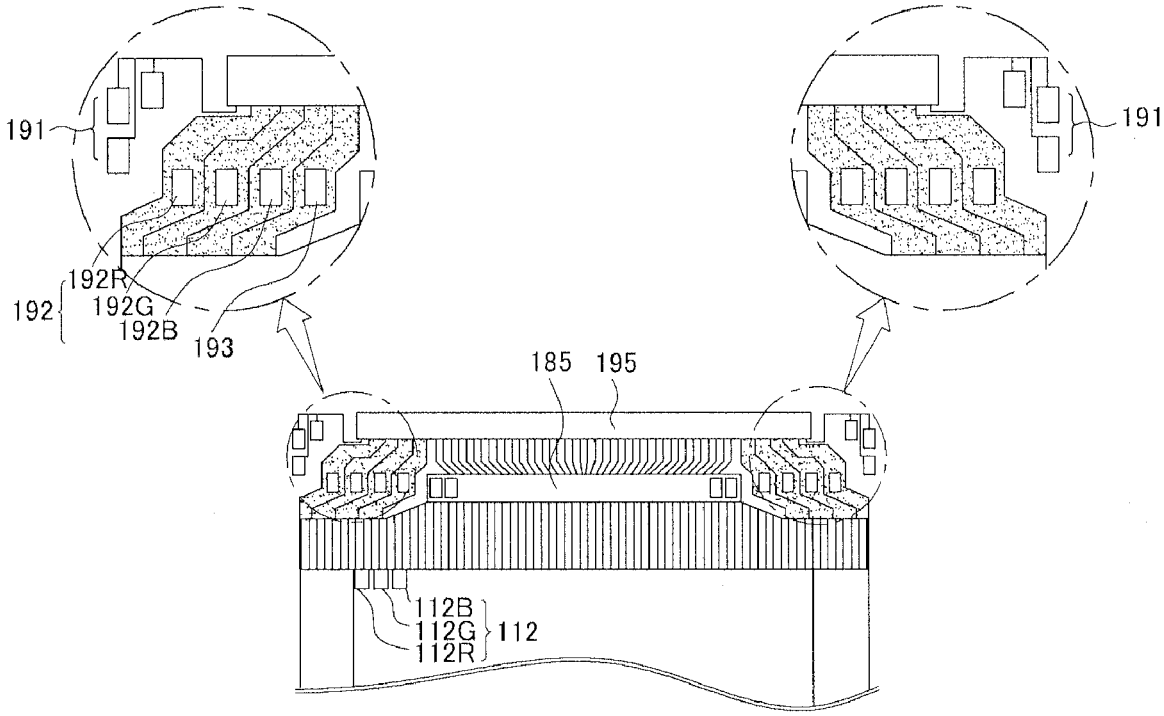
FIG. 3 is an enlarged view of a partial area of FIG. 2.
Figure 4A:
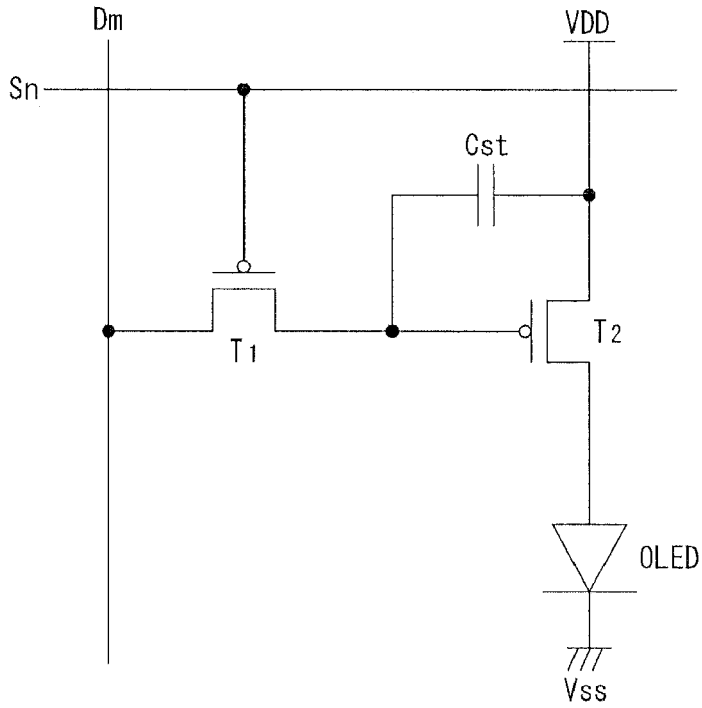
FIGS. 4A and 4B are circuit diagrams of a subpixel of the light emitting device.
Figure 4B:
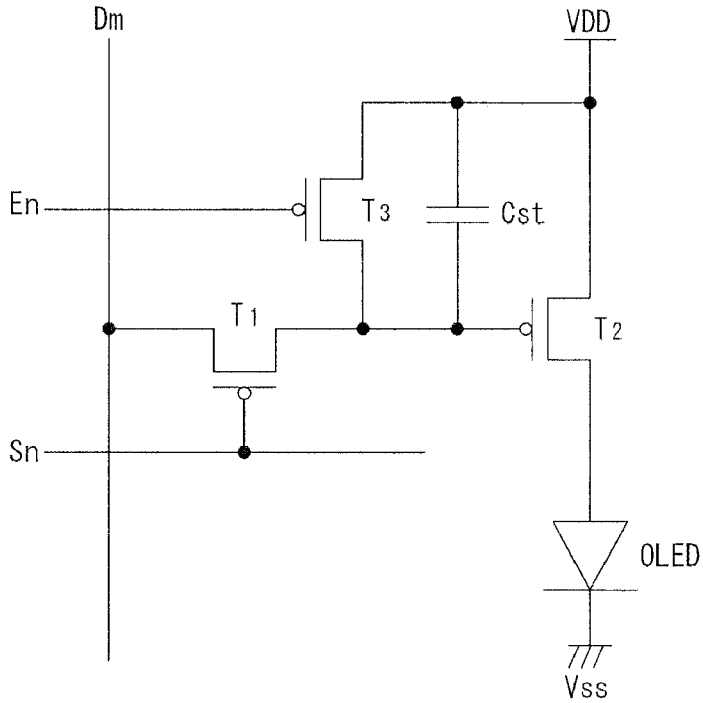

FIG. 1 is a bock diagram of a light emitting device according to an exemplary embodiment, FIG. 2 is a schematic plane view of the light emitting device, FIG. 3 is an enlarged view of a partial area of FIG. 2, and FIGS. 4A and 4B are circuit diagrams of a subpixel of the light emitting device.

As shown in FIG. 1, the light emitting device according to the exemplary embodiment includes a display panel 100, a scan driver 200, a data driver 300, and a controller 400.

The display panel 100 includes a plurality of scan lines S1 to Sn for transmitting scan signals, a plurality of data lines D1 to Dm for transmitting data signals, a plurality of power supply lines (not shown), and a plurality of subpixels PX arranged in a matrix format to be connected to the lines S1 to Sn and D1 to Dm and the power supply lines. Each power supply line may transmit voltages such as a power voltage VDD to each subpixel PX.

Although the display panel 100 includes the scan lines S1 to Sn and the data lines D1 to Dm in FIG. 1, the exemplary embodiment is not limited thereto. The display panel 100 may further include erase lines (not shown) for transmitting erase signals depending on a driving manner.

However, the erase lines may not be used to transmit the erase signals. The erase signal may be transmitted through another signal line. For instance, although it is not shown, the erase signal may be supplied to the display panel 100 through the power supply line in case that the power supply line for supplying the power voltage VDD is formed.

As shown in FIG. 4A, the subpixel PX may include a switching thin film transistor T1 transmitting a data signal in response to a scan signal transmitted through the scan line Sn, a capacitor Cst storing the data signal, a driving thin film transistor T2 producing a driving current corresponding to a voltage difference between the data signal stored in the capacitor Cst and the power voltage VDD, and a light emitting diode (OLED) emitting light corresponding to the driving current.

As shown in FIG. 4B, the subpixel PX may include a switching thin film transistor T1 transmitting a data signal in response to a scan signal transmitted through the scan line Sn, a capacitor Cst storing the data signal, a driving thin film transistor T2 producing a driving current corresponding to a voltage difference between the data signal stored in the capacitor Cst and the power voltage VDD, a light emitting diode (OLED) emitting light corresponding to the driving current, and an erase switching thin film transistor T3 erasing the data signal stored in the capacitor Cst in response to an erase signal transmitted through an erase line En.

When the display device is driven in a digital driving manner that represents a gray scale by dividing one frame into a plurality of subfields, the pixel circuit of FIG. 4B can control a light emitting time by supplying the erase signal to the subfield PX whose the light-emission time is shorter than an addressing time. The pixel circuit of FIG. 4B has an advantage capable of reducing a minimum luminance of the display device.

A difference between driving voltages, e.g., the power voltages VDD and Vss of the light emitting device may change depending on the size of the display panel 100 and a driving manner. A magnitude of the driving voltage is shown in the following Tables 1 and 2. Table 1 indicates a driving voltage magnitude in case of a digital driving manner, and Table 2 indicates a driving voltage magnitude in case of an analog driving manner.

TABLE 1

| Size (S) of display panel | VDD-Vss (R) | VDD-Vss (G) | VDD-Vss (B) |
|---|---|---|---|
| S < 3 inches | 3.5-10 (V) | 3.5-10 (V) | 3.5-12 (V) |
| 3 inches < S < 20 inches | 5-15 (V) | 5-15 (V) | 5-20 (V) |
| 20 inches < S | 5-20 (V) | 5-20 (V) | 5-25 (V) |

TABLE 2

| Size (S) of display panel | VDD-Vss (R, G, B) |
|---|---|
| S < 3 inches | 4~20 (V) |
| 3 inches < S < 20 inches | 5~25 (V) |
| 20 inches < S | 5~30 (V) |

Referring again to FIG. 1, the scan driver 200 is connected to the scan lines S1 to Sn to apply scan signals capable of turning on the switching thin film transistor T1 to the scan lines S1 to Sn, respectively.

The data driver 300 is connected to the data lines D1 to Dm to apply data signals indicating an output video signal DAT' to the data lines D1 to Dm, respectively. The data driver 300 may include at least one data driving integrated circuit (IC) connected to the data lines D1 to Dm.

The data driving IC may include a shift register, a latch, a digital-to-analog (DA) converter, and an output buffer which are connected to one another in the order named.

When a horizontal sync start signal (STH) (or a shift clock signal) is received, the shift register can transmit the output video signal DAT' to the latch in response to a data clock signal (HLCK). In case that the data driver 300 includes a plurality of data driving ICs, a shift register of a data driving IC can transmit a shift clock signal to a shift register of a next data driving IC.

The latch memorizes the output video signal DAT', selects a gray voltage corresponding to the memorized output video signal DAT' in response to a load signal, and transmits the gray voltage to the output buffer.

The DA converter selects the corresponding gray voltage in response to the output video signal DAT' and transmits the gray voltage to the output buffer.

The output buffer outputs an output voltage (serving as a data signal) received from the DA converter to the data lines D1 to Dm, and maintains the output of the output voltage for 1 horizontal period (1H).

The controller 400 controls operations of the scan driver 200 and the data driver 300. The controller 400 may include a signal conversion unit 450 that gamma-converts input video signals R, G and B into the output video signal DAT and produces the output video signal DAT'.

The controller 400 produces a scan control signal CONT1 and a data control signal CONT2, and the like. Then, the controller 400 outputs the scan control signal CONT1 to the scan driver 200 and outputs the data control signal CONT2 and the processed output video signal DAT' to the data driver 300.

The controller 400 receives the input video signals R, G and B and an input control signal for controlling the display of the input video signals R, G and B from a graphic controller (not shown) positioned outside the light emitting device. Examples of the input control signal include a vertical sync signal Vsync, a horizontal sync signal Hsync, a main clock signal MCLK and a data enable signal DE.

Each of the driving devices 200, 300 and 400 may be directly mounted on the display panel 100 in the form of at least one IC chip, or may be attached to the display panel 100 in the form of a tape carrier package (TCP) in a state where the driving devices 200, 300 and 400 each are mounted on a flexible printed circuit film (not shown), or may be mounted on a separate printed circuit board (not shown). Alternatively, each of the driving devices 200, 300 and 400 may be integrated on the display panel 100 together with elements such as the plurality of signal lines S1 to Sn and D1 to Dm or the thin film transistors T1, T2 and T3.

Further, the driving devices 200, 300 and 400 may be integrated into a single chip. In this case, at least one of the driving devices 200, 300 and 400 or at least one circuit element constituting the driving devices 200, 300 and 400 may be positioned outside the single chip.

As shown in FIG. 2, the light emitting device according to the exemplary embodiment includes a substrate 110, and a display unit 113. The display unit 113 includes a plurality of subpixels 112 arranged in a matrix format on the substrate 110. Each subpixel 112 includes red, green, and blue subpixels 112R, 112G, and 112B. The subpixels 112 may emit light of another color in addition to red, green, and blue light.

Signal lines 140 are positioned on the substrate 110. The signal lines 140 includes scan lines, data lines, power supply lines, and ground lines, and the like, which are connected to the subpixels 112.

A pad unit 185 is positioned at either edge of the substrate 110. The scan driver 200 and the data driver 300 electrically connected to some of the signal lines 140 are mounted on the pad unit 185 to supply the scan signal and the data signal to some of the signal lines 140. The pad unit 185 may have a square or rectangular shape.

A connection pad unit 195 is positioned at either edge of the substrate 110. The connection pad unit 195 is electrically connected to the signal lines 140 and the unit 185 through a flexible cable (for example, flexible printed circuit (FPC)) to receive a driving signal from an external device.

A dummy pad unit 190 is positioned at both sides of the pad unit 185 outside the pad unit 185 to be connected to the signal lines 140 connected to the subpixels 112. The dummy pad unit 190 may be positioned on the signal lines 140.

The dummy pad unit 190 is used to perform an aging process on the subpixels 112 connected to the dummy pad unit 190 after the light emitting device is manufactured. Therefore, a separate device for supplying a signal required to perform the aging process is not necessary. Further, the aging process can be easily performed using a contacting manner of the dummy pad unit 190 (i.e., the substrate) and a pin (i.e., an aging device).

As shown in FIGS. 2 and 3, the dummy pad unit 190 includes an auxiliary pad 191 supplying a signal for turning on at least one transistor included in each subpixel 112, a first power pad 192 supplying a first power to the subpixels 112, and a second power pad 193 supplying a second power to the subpixels 112. The first power pad 192 may be a power supply lines, and the second power pad 193 may be a ground line.

The first power pad 192 may include red, green, and blue power pads 192R, 192G, and 192B which are connected to the red, green, and blue subpixels 112R, 112G, and 112B, respectively.

Each of the first and second power pads 192 and 193 may be positioned at both sides of the pad unit 185 outside the pad unit 185. A plurality of unit pads constituting the first and second power pads 192 and 193 may have the same size and the same height, and be positioned at the same location. A width of the signal lines connected to the first and second power pads 192 and 193 may be larger than a width of the first and second power pads 192 and 193.

A width of the signal line connected to the first and second power pads 192 and 193 is larger than a width of the signal line connected to the auxiliary pad 191.

The structure of the above pad units is designed to widen a contact area and consider a resistance problem generated during the signal transmission.

The same number of dummy pad units 190 is positioned at each of both sides of the pad unit 185 outside the pad unit 185 so that signals received from pins contacting the dummy pad unit 190 are uniformly supplied to both sides of the substrate 110. The dummy pad unit 190 is used to supply the same signal to the subpixels 112 positioned inside the display unit 113.

Accordingly, a problem (i.e., a reduction in a luminance of the subpixels 112 as the subpixels 112 go in either direction of the substrate 110) caused by supplying the signal to only one of both sides of the substrate 110 can be solved. In other words, the non-uniformity of luminance caused by a reduction or a drop in a current due to a resistance (IR drop) can be solved.

Figure 5:
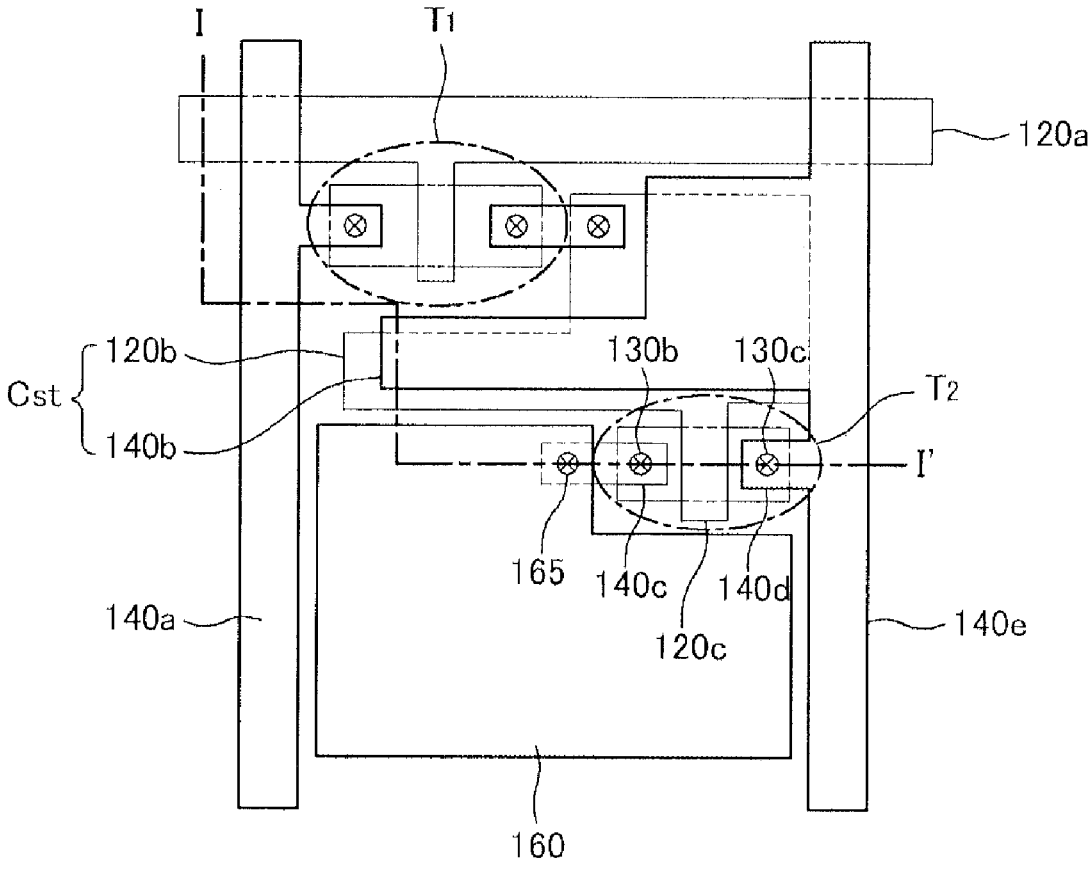
FIG. 5 is a plane view showing a structure of a subpixel of the light emitting device.

FIG. 5 is a plane view showing a structure of a subpixel of the light emitting device.

Figure 6A:
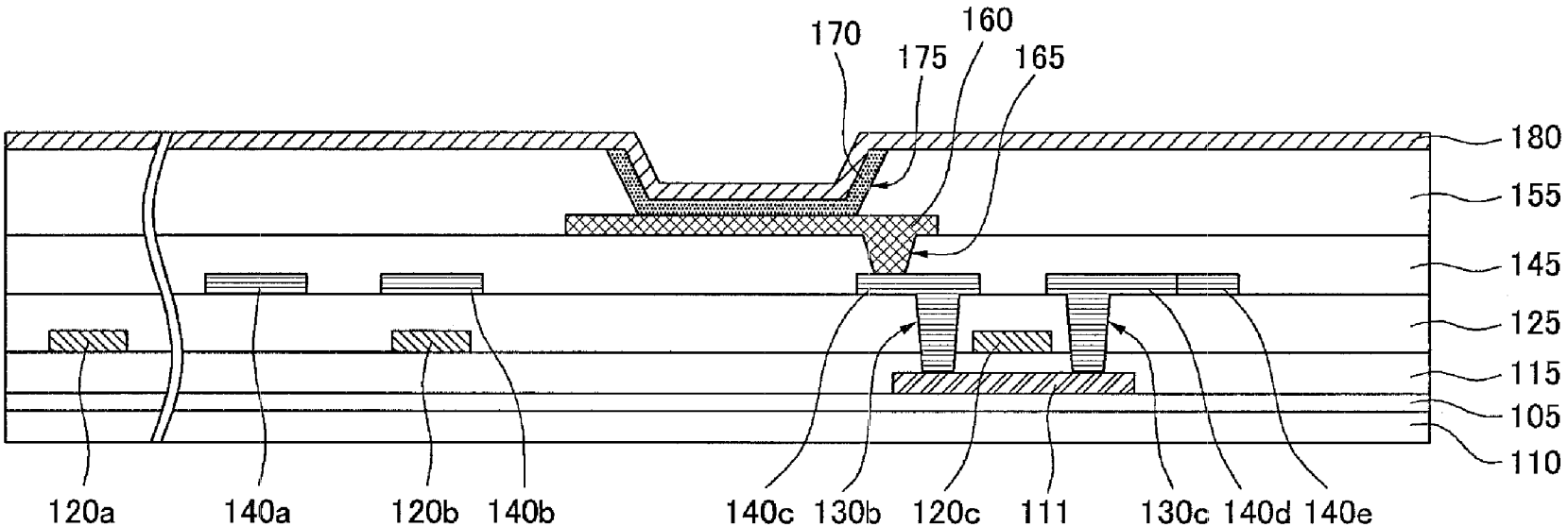
FIGS. 6A and 6B are cross-sectional views taken along line I-I' of FIG. 5.
Figure 6B:
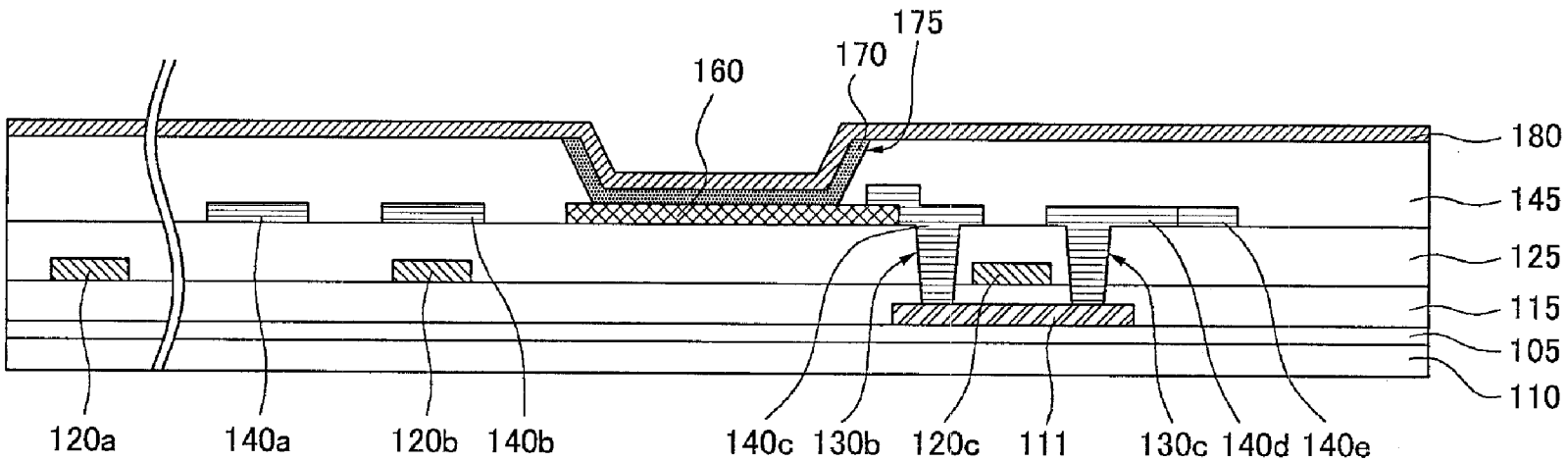

FIGS. 5, 6A and 6B show a structure of the subpixel of the light emitting device according to the exemplary embodiment. This structure includes the substrate 110 having a plurality of subpixel and non-subpixel areas. As shown, for instance, in FIG. 5, the subpixel area and the non-subpixel area may be defined by a scan line 120*a* that extends in one direction, a data line 140*a* that extends substantially perpendicular to the scan line 120*a*, and a power supply line 140*e* that extends substantially parallel to the data line 140*a*.

The subpixel area may include a switching thin film transistor T1 connected to the scan line 120*a* and the data line 140*a*, a capacitor Cst connected to the switching thin film transistor T1 and the power supply line 140*e*, and a driving thin film transistor T2 connected to the capacitor Cst and the power supply line 140*e*. The capacitor Cst may include a capacitor lower electrode 120*b* and a capacitor upper electrode 140*b*.

The subpixel area may also include a light emitting diode, which includes a first electrode 160 electrically connected to the driving thin film transistor T 2, a light emitting layer (not shown) on the first electrode 160, and a second electrode (not shown). The non-subpixel area may include the scan line 120*a*, the data line 140*a* and the power supply line 140*e*.

FIGS. 6A and 6B are cross-sectional views taken along line I-I' of FIG. 5.

As shown in FIG. 6A, a buffer layer 105 is positioned on the substrate 110. The buffer layer 105 prevents impurities (e.g., alkali ions discharged from the substrate 110) from being introduced during formation of the thin film transistor in a succeeding process. The buffer layer 105 may be selectively formed using silicon oxide (SiO2), silicon nitride (SiNX), or using other materials. The substrate 110 may be formed of glass, plastic or metal.

A semiconductor layer 111 is positioned on the buffer layer 105. The semiconductor layer 111 may include amorphous silicon or crystallized polycrystalline silicon. The semiconductor layer 111 may include a source region and a drain region including p-type or n-type impurities. The semiconductor layer 111 may include a channel region in addition to the source region and the drain region.

A first insulating layer 115, which may be a gate insulating layer, is positioned on the semiconductor layer 111. The first insulating layer 115 may include a silicon oxide ($SiO_X$) layer, a silicon nitride ($SiN_X$) layer, or a multi-layered structure or a combination thereof.

A gate electrode 120*c* is positioned on the first insulating layer 115 in a given area of the semiconductor layer 111, e.g., at a location corresponding to the channel region of the semiconductor layer 111 when impurities are doped. The scan line 120*a* and the capacitor lower electrode 120*b* may be positioned on the same formation layer as the gate electrode 120*c*.

The gate electrode 120*c* may be formed of any one selected from the group consisting of molybdenum (Mo), aluminum (Al), chromium (Cr), gold (Au), titanium (Ti), nickel (Ni), neodymium (Nd) and copper (Cu), or a combination thereof. The gate electrode 120*c* may have a multi-layered structure formed of Mo, Al, Cr, Au, Ti, Ni, Nd, or Cu, or a combination thereof. The gate electrode 120*c* may have a double-layered structure including Mo/Al—Nd or Mo/Al.

The scan line 120*a* may be formed of any one selected from the group consisting of Mo, Al, Cr, Au, Ti, Ni, Nd, or Cu, or a combination thereof. The scan line 120*a* may have a multi-layered structure formed of Mo, Al, Cr, Au, Ti, Ni, Nd, or Cu, or a combination thereof. The scan line 120*a* may have a double-layered structure including Mo/Al—Nd or Mo/Al.

A second insulating layer 125, which may be an interlayer dielectric, is positioned on the substrate 110 on which the scan line 120*a*, the capacitor lower electrode 120*b* and the gate electrode 120*c* are positioned. The second insulating layer 125 may include a silicon oxide ($SiO_X$) layer, a silicon nitride ($SiN_X$) layer, or a multi-layered structure or a combination thereof.

Contact holes 130*b* and 130*c* are positioned inside the second insulating layer 125 and the first insulating layer 115 to expose a portion of the semiconductor layer 111.

A drain electrode 140*c* and a source electrode 140*d* are positioned in the subpixel area to be electrically connected to the semiconductor layer 111 through the contact holes 130*b* and 130*c* passing through the second insulating layer 125 and the first insulating layer 115.

The drain electrode 140*c* and the source electrode 140*d* may have a single-layered structure or a multi-layered structure. When the drain electrode 140*c* and the source electrode 140*d* have the single-layered structure, the drain electrode 140*c* and the source electrode 140*d* may be formed of Mo, Al, Cr, Au, Ti, Ni, Nd, or Cu, or a combination thereof.

When the drain electrode 140*c* and the source electrode 140*d* have the multi-layered structure, the drain electrode 140*c* and the source electrode 140*d* may have a double-layered structure including Mo/Al—Nd or a triple-layered structure including Mo/Al/Mo or Mo/Al—Nd/Mo.

The data line 140*a*, the capacitor upper electrode 140*b*, and the power supply line 140*e* may be positioned on the same formation layer as the drain electrode 140*c* and the source electrode 140*d*.

The data line 140*a* and the power supply line 140*e* positioned in the non-subpixel area may have a single-layered structure or a multi-layered structure. When the data line 140*a* and the power supply line 140*e* have the single-layered structure, the data line 140*a* and the power supply line 140*e* may be formed of Mo, Al, Cr, Au, Ti, Ni, Nd, or Cu, or a combination thereof.

When the data line 140*a* and the power supply line 140*e* have the multi-layered structure, the data line 140*a* and the power supply line 140*e* may have a double-layered structure including Mo/Al—Nd or a triple-layered structure including Mo/Al/Mo or Mo/Al—Nd/Mo. The data line 140*a* and the power supply line 140*e* may have a triple-layered structure including Mo/Al—Nd/Mo.

A third insulating layer 145 is positioned on the data line 140*a*, the capacitor upper electrode 104*b*, the drain electrode 140*c*, the source electrode 140*d*, and the power supply line 140*e*. The third insulating layer 145 may be a planarization layer for obviating the height difference of a lower structure. The third insulating layer 145 may be formed using a method such as spin on glass (SOG) obtained by coating an organic material such as polyimide, benzocyclobutene-based resin and acrylate in the liquid form and then hardening it. Further, an inorganic material such a silicone oxide may be used. Otherwise, the third insulating layer 145 may be a passivation layer, and may include a silicon oxide ($SiO_X$) layer, a silicon nitride ($SiN_X$) layer, or a multi-layered structure including a combination thereof.

A via hole 165 is positioned inside the third insulating layer 145 to expose any one of the source and drain electrodes 140*c* and 140*d*. The first electrode 160 is positioned on the third insulating layer 145 to be electrically connected to any one of the source and drain electrodes 140*c* and 140*d* via the via hole 165.

The first electrode 160 may be an anode electrode. In case that the light emitting device has a bottom emission or dual emission structure, the first electrode 160 may be formed of a transparent material such as indium-tin-oxide (ITO), indium-zinc-oxide (IZO), or zinc oxide (ZnO). In case that the light emitting device has a top emission structure, the first electrode 160 may include a layer formed of one of ITO, IZO or ZnO, and a reflective layer formed of one of Al, Ag or Ni under the layer. Further, the first electrode 160 may have a multi-layered structure in which the reflective layer is positioned between two layers formed of one of ITO, IZO or ZnO.

A fourth insulating layer 155 including an opening 175 is positioned on the first electrode 160. The opening 175 provides electrical insulation between the neighboring first electrodes 160 and exposes a portion of the first electrode 160. A light emitting layer 170 is positioned on the first electrode 160 exposed by the opening 175.

A second electrode 180 is positioned on the light emitting layer 170. The second electrode 180 may be a cathode electrode, and may be formed of Mg, Ca, Al and Ag having a low work function or a combination thereof. In case that the light emitting device has a top emission or dual emission structure, the second electrode 180 may be thin enough to transmit light. In case that the light emitting device has a bottom emission structure, the second electrode 180 may be thick enough to reflect light.

The light emitting device according to the exemplary embodiment using a total of 7 masks was described as an example. The 7 masks may be used in a process for forming each of the semiconductor layer, the gate electrode (including the scan line and the capacitor lower electrode), the contact holes, the source and drain electrodes (including the data line, the power supply line and the capacitor upper electrode), the via holes, the first electrode, and the opening.

An example of how a light emitting device is formed using a total of 5 masks will now be given.

As shown in FIG. 6B, the buffer layer 105 is positioned on the substrate 100, and the semiconductor layer 111 is positioned on the buffer layer 105. The first insulating layer 115 is positioned on the semiconductor layer 111. The gate electrode 120*c*, the capacitor lower electrode 120*b*, and the scan line 120*a* are positioned on the first insulating layer 115. The second insulating layer 125 is positioned on the gate electrode 120*c*.

The first electrode 160 is positioned on the second insulating layer 125, and the contact holes 130*b* and 130*c* are positioned to expose the semiconductor layer 111. The first electrode 160 and the contact holes 130*b* and 130*c* may be simultaneously formed.

The source electrode 140*d*, the drain electrode 140*c*, the data line 140*a*, the capacitor upper electrode 140*b*, and the power supply line 140*e* are positioned on the second insulating layer 125. A portion of the drain electrode 140*c* may be positioned on the first electrode 160.

A pixel or subpixel definition layer or the third insulating layer 145, which may be a bank layer, is positioned on the substrate 110 on which the above-described structure is formed. The opening 175 is positioned on the third insulating layer 145 to expose the first electrode 160. The light emitting layer 170 is positioned on the first electrode 160 exposed by the opening 175, and the second electrode 180 is positioned on the light emitting layer 170.

The aforementioned light emitting device can be manufactured using a total of 5 masks. The 5 masks are used in a process for forming each of the semiconductor layer, the gate electrode (including the scan line and the capacitor lower electrode), the first electrode (including the contact holes), the source and drain electrodes (including the data line, the power supply line and the capacitor upper electrode), and the opening. Accordingly, the light emitting device according to the exemplary embodiment can reduce the manufacturing cost by a reduction in the number of masks and can improve the efficiency of mass production.

Various color image display methods may be implemented in the light emitting device such as described above. These methods will be described below with reference to FIGS. 7A to 7C.

Figure 7A:
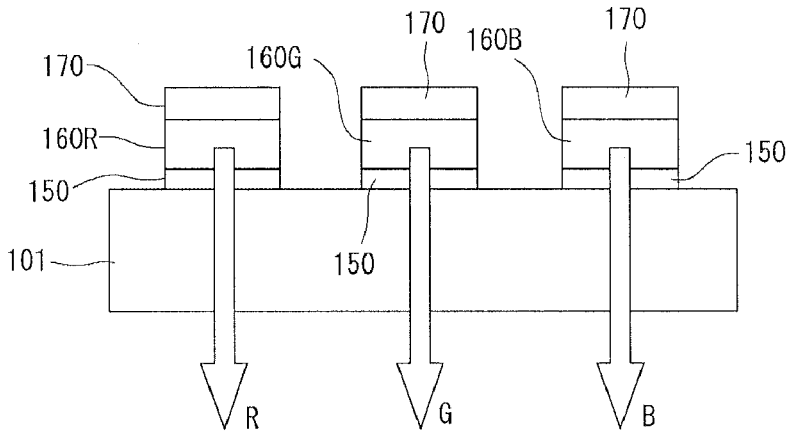
FIGS. 7A to 7C illustrate various implementations of a color image display method in the light emitting device.
Figure 7B:
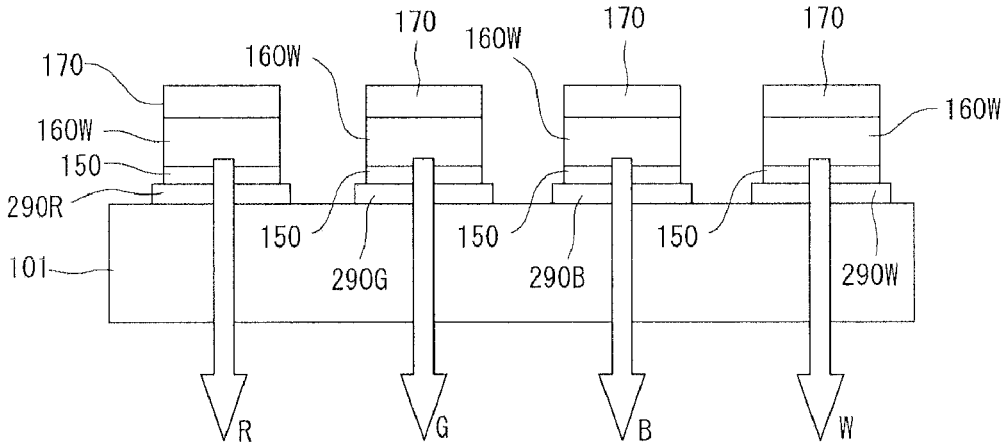
Figure 7C:
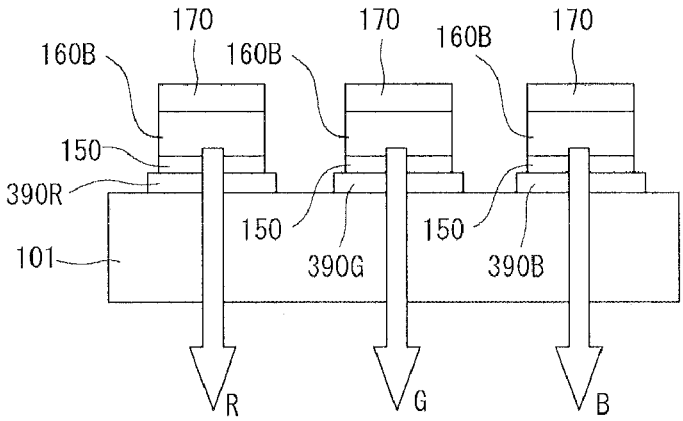

FIGS. 7A to 7C illustrate various implementations of a color image display method in the light emitting device.

FIG. 7A illustrates a color image display method in a light emitting device that separately includes a red light emitting layer 170R to emit red light, a green light emitting layer 170G to emit green light, and a blue light emitting layer 170B to emit blue light. The red, green and blue light produced by the red, green and blue light emitting layers 170R, 170G and 170B is mixed to display a color image.

In FIG. 7A, the red, green and blue light emitting layers 170R, 170G and 170B may each include an electron transport layer, a hole transport layer, and the like. It is possible to variously change an arrangement and a structure between additional layers such as the electron transport layer and the hole transport layer and each of the red, green and blue light emitting layers 170R, 170G and 170B.

FIG. 7B illustrates a color image display method in a light emitting device including a white light emitting layer 270W, a red color filter 290R, a green color filter 290G, a blue color filter 290B, and a white color filter 290W.

As shown in FIG. 7B, the red color filter 290R, the green color filter 290G, the blue color filter 290B, and the white color filter 290W each transmit white light produced by the white light emitting layer 270W and produce red light, green light, blue light, and white light. The red, green, blue, and white light is mixed to display a color image. The white color filter 290W may be removed depending on color sensitivity of the white light produced by the white light emitting layer 270W and combination of the white light and the red, green and blue light.

While FIG. 7B has illustrated the color display method of four subpixels using combination of the red, green, blue, and white light, a color display method of three subpixels using combination of the red, green, and blue light may be used.

In FIG. 7B, the white light emitting layer 270W may include an electron transport layer, a hole transport layer, and the like. It is possible to variously change an arrangement and a structure between additional layers such as the electron transport layer and the hole transport layer and the white light emitting layer 270W.

FIG. 7C illustrates a color image display method in a light emitting device including a blue light emitting layer 370B, a red color change medium 390R, a green color change medium 390G, and a blue color change medium 390B.

As shown in FIG. 7C, the red color change medium 390R, the green color change medium 390G, and the blue color change medium 390B each transmit blue light produced by the blue light emitting layer 370B to produce red light, green light and blue light. The red, green and blue light is mixed to display a color image.

The blue color change medium 390B may be removed depending on color sensitivity of the blue light produced by the blue light emitting layer 370B and combination of the blue light and the red and green light.

In FIG. 7C, the blue light emitting layer 370B may include an electron transport layer, a hole transport layer, and the like. It is possible to variously change an arrangement and a structure between additional layers such as the electron transport layer and the hole transport layer and the blue light emitting layer 370B.

While FIGS. 7A to 7C have illustrated and described the light emitting device having a bottom emission structure, the exemplary embodiment is not limited thereto. The display device according to the exemplary embodiment may have a top emission structure, and thus can a different arrangement and a different structure depending on the top emission structure.

While FIGS. 7A to 7C have illustrated and described three kinds of color image display method, the exemplary embodiment is not limited thereto. The exemplary embodiment may use various kinds of color image display method whenever necessary.

Figure 8:
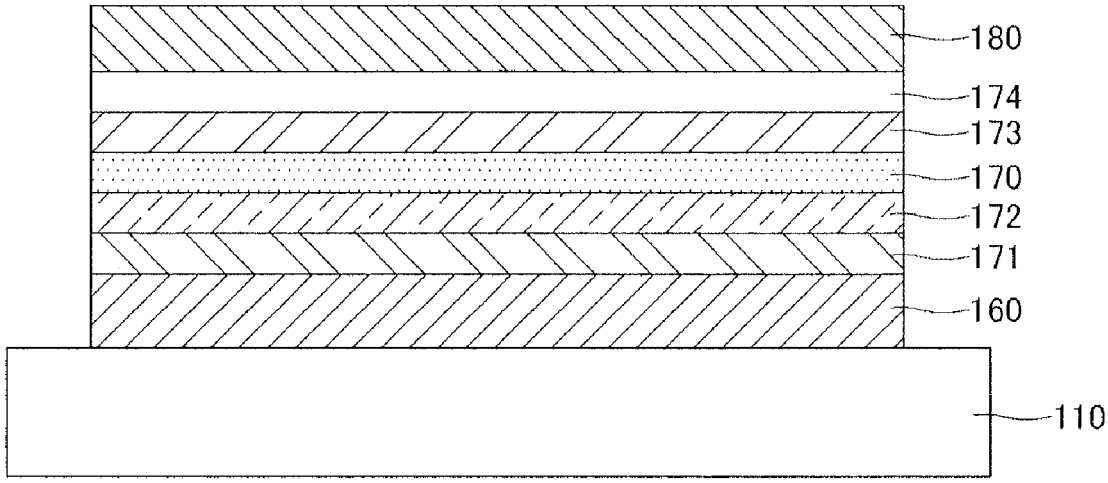
FIG. 8 is a cross-sectional view of the light emitting device.

FIG. 8 is a cross-sectional view of the light emitting device.

As shown in FIG. 8, the light emitting device according to the exemplary embodiment includes the substrate 110, the first electrode 160 on the substrate 110, a hole injection layer 171 on the first electrode 160, a hole transport layer 172, a light emitting layer 170, an electron transport layer 173, an electron injection layer 174, and the second electrode 180 on the electron injection layer 174.

The hole injection layer 171 may function to facilitate the injection of holes from the first electrode 160 to the light emitting layer 170. The hole injection layer 171 may be formed of at least one selected from the group consisting of copper phthalocyanine (CuPc), PEDOT(poly(3,4)-ethylenedioxythiophene), polyaniline (PANI) and NPD(N,N-dinaphthyl-N,N'-diphenyl benzidine), but is not limited thereto. The hole injection layer 171 may be formed using an evaporation method or a spin coating method.

The hole transport layer 172 functions to smoothly transport holes. The hole transport layer 172 may be formed from at least one selected from the group consisting of NPD(N,N-dinaphthyl-N,N'-diphenyl benzidine), TPD(N,N'-bis-(3-methylphenyl)-N,N'-bis-(phenyl)-benzidine, s-TAD and MTDATA(4,4',4"-Tris(N-3-methylphenyl-N-phenyl-amino)-triphenylamine), but is not limited thereto. The hole transport layer 172 may be formed using an evaporation method or a spin coating method.

The light emitting layer 170 may be formed of a material capable of producing red, green, blue and white light, for example, a phosphorescence material or a fluorescence material.

In case that the light emitting layer 170 produces red light, the light emitting layer 170 includes a host material including carbazole biphenyl (CBP) or N,N-dicarbazolyl-3,5-benzene (mCP). Further, the light emitting layer 170 may be formed of a phosphorescence material including a dopant material including any one selected from the group consisting of PIQIr(acac)(bis(1-phenylisoquinoline)acetylacetonate iridium), PQIr(acac)(bis(1-phenylquinoline)acetylacetonate iridium), PQIr(tris(1-phenylquinoline)iridium) and PtOEP(octaethylporphyrin platinum) or a fluorescence material including PBD:Eu(DBM)3(Phen) or Perylene, but is not limited thereto.

In case that the light emitting layer 170 produces green light, the light emitting layer 170 includes a host material including CBP or mCP. Further, the light emitting layer 170 may be formed of a phosphorescence material including a dopant material including Ir(ppy)3(fac tris(2-phenylpyridine)iridium) or a fluorescence material including Alq3(tris(8-hydroxyquinolino)aluminum), but is not limited thereto.

In case that the light emitting layer 170 produces blue light, the light emitting layer 170 includes a host material including CBP or mCP. Further, the light emitting layer 170 may be formed of a phosphorescence material including a dopant material including (4,6-F2 ppy)2Irpic or a fluorescence material including any one selected from the group consisting of spiro-DPVBi, spiro-6P, distyryl-benzene (DSB), distyryl-arylene (DSA), PFO-based polymers, PPV-based polymers and a combination thereof, but is not limited thereto.

The electron transport layer 173 functions to facilitate the transportation of electrons. The electron transport layer 173 may be formed of at least one selected from the group consisting of Alq3(tris(8-hydroxyquinolino)aluminum, PBD, TAZ, spiro-PBD, BAlq, and SAlq, but is not limited thereto. The electron transport layer 173 may be formed using an evaporation method or a spin coating method.

The electron transport layer 173 can also function to prevent holes, which are injected from the first electrode 160 and then pass through the light emitting layer 170, from moving to the second electrode 180. In other words, the electron transport layer 173 serves as a hole stop layer, which facilitates the coupling of holes and electrons in the light emitting layer 170.

The electron injection layer 174 functions to facilitate the injection of electrons. The electron injection layer 174 may be formed of Alq3(tris(8-hydroxyquinolino)aluminum), PBD, TAZ, spiro-PBD, BAlq or SAlq, but is not limited thereto. The electron injection layer 174 may be formed of an organic material and an inorganic material forming the electron injection layer 174 through a vacuum evaporation method.

The hole injection layer 171 or the electron injection layer 174 may further include an inorganic material. The inorganic material may further include a metal compound. The metal compound may include alkali metal or alkaline earth metal. The metal compound including the alkali metal or the alkaline earth metal may include at least one selected from the group consisting of LiQ, LiF, NaF, KF, RbF, CsF, FrF, $BeF_2$, $MgF_2$, $CaF_2$, $SrF_2$, $BaF_2$, and $RaF_2$, but is not limited thereto.

Thus, the inorganic material inside the electron injection layer 174 facilitates hopping of electrons injected from the second electrode 180 to the light emitting layer 170, so that holes and electrons injected into the light emitting layer 170 are balanced. Accordingly, the light emission efficiency can be improved.

Further, the inorganic material inside the hole injection layer 171 reduces the mobility of holes injected from the first electrode 160 to the light emitting layer 170, so that holes and electrons injected into the light emitting layer 170 are balanced. Accordingly, the light emission efficiency can be improved.

At least one of the electron injection layer 174, the electron transport layer 173, the hole transport layer 172, the hole injection layer 171 may be omitted.

Figure 9:
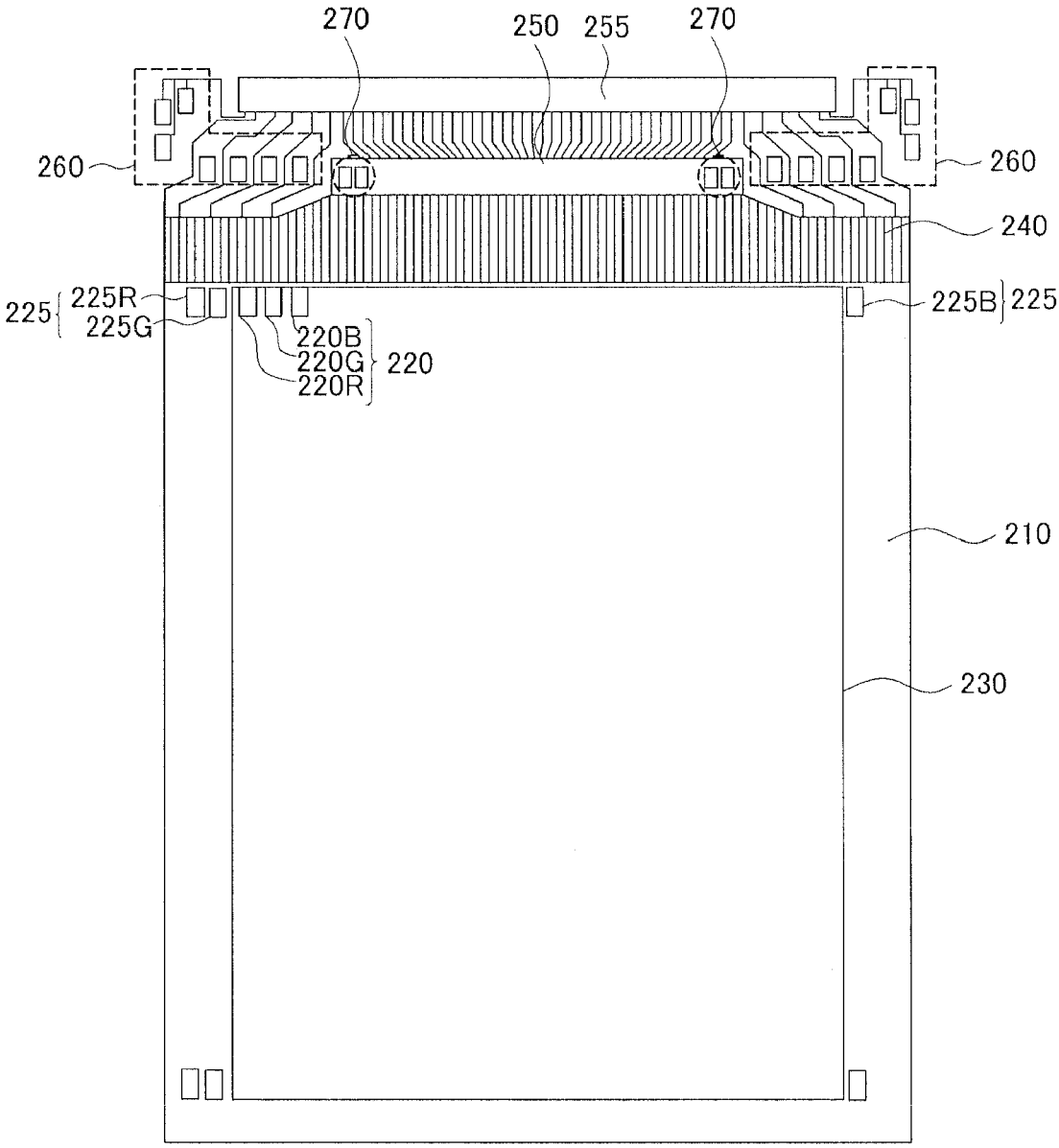
FIG. 9 is a schematic plane view of a light emitting device according to another exemplary embodiment.

FIG. 9 is a schematic plane view of a light emitting device according to another exemplary embodiment.

As shown in FIG. 9, the light emitting device according to another exemplary embodiment includes a substrate 210, and a display unit 230, and a plurality of monitor pixels 225. The display unit 230 includes a plurality of subpixels 220 arranged in a matrix format on the substrate 210.

Each subpixel 220 includes red, green, and blue subpixels 220R, 220G, and 220B, and each monitor pixel 225 includes red, green, and blue monitor pixels 225R, 225G, and 225B. The subpixels 220 and the monitor pixels 225 may emit light of another color in addition to red, green, and blue light. At least one the monitor pixel 225 may be positioned outside the display unit 230 on each scan line. In other words, the red, green, and blue monitor pixels 225R, 225G, and 225B may be positioned on each scan line.

Signal lines 240 are positioned on the substrate 210. The signal lines 240 includes scan lines, data lines, power supply lines, and ground lines, and the like, which are connected to the subpixels 220 and the monitor pixels 225.

A pad unit 250 is positioned at either edge of the substrate 210. A scan driver and a data driver electrically connected to some of the signal lines 240 are mounted on the pad unit 250 to supply driving signals to the signal lines 240. The pad unit 250 may have a square or rectangular shape.

A connection pad unit 255 is positioned at either edge of the substrate 210. The connection pad unit 255 is electrically connected to the signal lines 240 and the pad unit 250 through a flexible cable (for example, flexible printed circuit (FPC)) to receive a driving signal from an external device.

A first dummy pad units 260 are positioned at both sides of the pad unit 250 outside the pad unit 250. The first dummy pad unit 260 is connected to the signal lines 240 connected to the subpixels 220 and at least one signal line 240 connected to the monitor pixels 225. The first dummy pad unit 260 may be positioned on the connected signal lines 240.

A second dummy pad unit 270 is positioned inside the pad unit 250 and connected to the power supply line of the signal lines 240 connected to the monitor pixels 225. Because the pad unit 250 is formed on the substrate 210 in the form of square or rectangular shape, the pad unit 250 has a space therein. Therefore, the second dummy pad unit 270 may be positioned in an internal space of the pad unit 250 so that the second dummy pad unit 270 does not to affect the signal lines 240 on the substrate 210 having a limited space.

The first and second dummy pad units 260 and 270 are used to perform an aging process on the subpixels 220 and the monitor pixels 225 connected to the first and second dummy pad units 260 and 270 after the light emitting device is manufactured. Therefore, a separate device for supplying a signal required to perform the aging process is not necessary. Further, the aging process can be easily performed using a contacting manner of the first and second dummy pad units 260 and 270 (i.e., the substrate) and a pin (i.e., an aging device).

Figure 10:
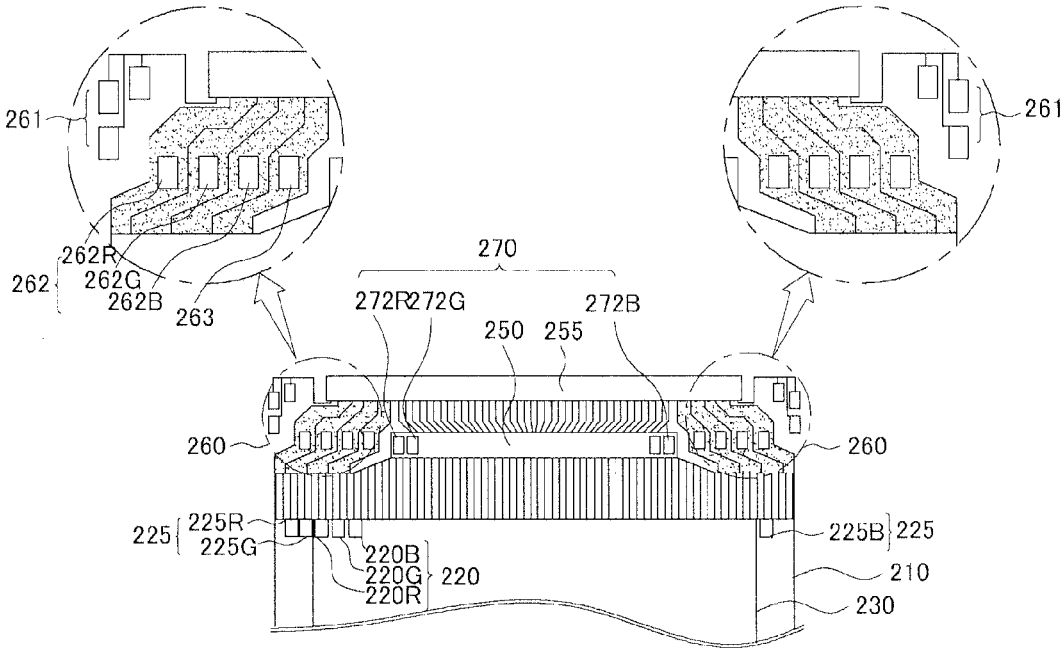
FIG. 10 is an enlarged view of a partial area of FIG. 9.

FIG. 10 is an enlarged view of a partial area of FIG. 9.

As shown in FIGS. 9 and 10, the first dummy pad unit 260 includes an auxiliary pad 261 supplying a signal for turning on at least one transistor included in each subpixel 220, a first power pad 262 supplying a first power to the subpixels 220, and a second power pad 263 supplying a second power to the subpixels 220.

The above pads 261, 262, and 263 receive signals required for the aging process from an external device. More specifically, the auxiliary pad 261 receives a switching signal for turning on all of transistors included in the subpixels 220 and the monitor pixels 225, and the first and second power pads 262 and 263 are a pad capable of supplying a power voltage to the subpixels 220 and the monitor pixels 225.

The first power pad 262 may include red, green, and blue power pads 262R, 262G, and 262B which are connected to the red, green, and blue subpixels 220R, 220G, and 220B, respectively.

Each of the first and second power pads 262 and 263 may be positioned at both sides of the pad unit 250 outside the pad unit 250. A plurality of unit pads constituting the first and second power pads 262 and 263 may have the same size and the same height, and be positioned at the same location. A width of the signal lines connected to the first and second power pads 262 and 263 may be larger than a width of the first and second power pads 262 and 263.

A width of the signal line connected to the first and second power pads 262 and 263 is larger than a width of the signal line connected to the auxiliary pad 261.

The structure of the above pad units is designed to widen a contact area and consider a resistance problem generated during the signal transmission.

The same number of first dummy pad units 260 is positioned at each of both sides of the pad unit 250 outside the pad unit 250 so that signals received from pins contacting the first dummy pad unit 260 are uniformly supplied to both sides of the substrate 210. The first dummy pad unit 260 is used to supply the same signal to the subpixels 220 positioned inside the display unit 230.

Accordingly, a problem (i.e., a reduction in a luminance of the subpixels 220 as the subpixels 220 go in either direction of the substrate 210) caused by supplying the signal to only one of both sides of the substrate 210 can be solved. In other words, the non-uniformity of luminance caused by a reduction or a drop in a current due to a resistance (IR drop) can be solved.

The second dummy pad unit 270 may include red, green, and blue monitor power pads 272R, 272G, and 272B which are connected to the red, green, and blue monitor pixels 225R, 225G, and 225B, respectively.

The second dummy pad unit 270 may be regularly or irregularly positioned in pairs at both edges of the pad unit 250 inside the pad unit 250. In other words, the number of second dummy pad units 270 at both edges of the pad unit 250 inside the pad unit 250 may be changed depending on the number of monitor pixels 225.

The second dummy pad unit 270 receives signals required for the aging process from the external device. The second dummy pad unit 270 provides a pad capable of simultaneously performing the aging process on the monitor pixels 225 when the aging process is performed on the subpixels 220.

Accordingly, because the aging process is performed on the monitor pixels 225 as well as the subpixels 220, driving signals required to drive the light emitting device can be efficiently supplied using the monitor pixels 225 in consideration of changes in a temperature or a slope of the subpixels 220 inside the display unit 230.

Figure 11:
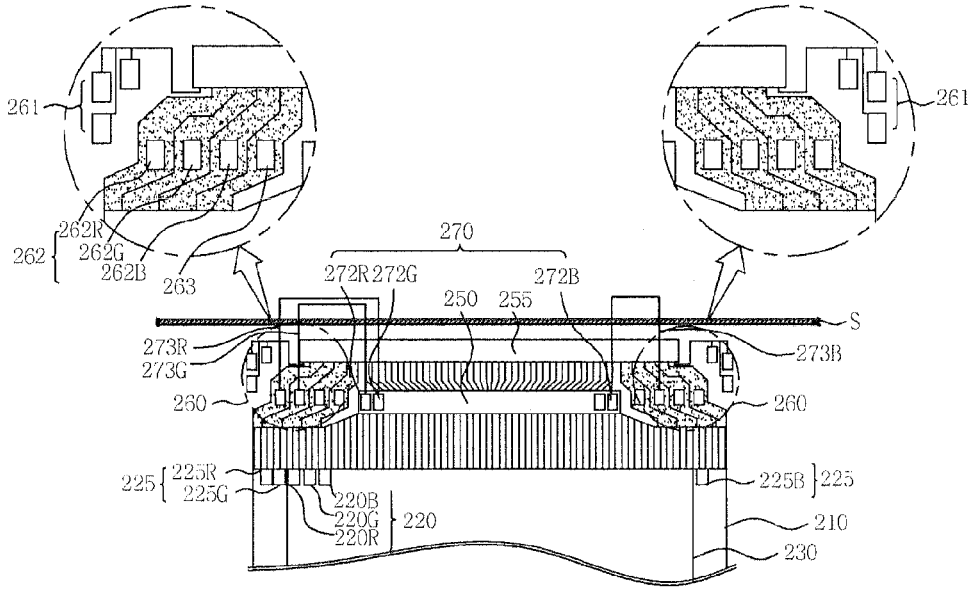
FIG. 11 is an enlarged view of a partial area of a light emitting device according to another exemplary embodiment.

FIG. 11 is an enlarged view of a partial area of a light emitting device according to another exemplary embodiment.

Structures and components identical or equivalent to those shown in FIGS. 9 and 11 are designated with the same reference numerals, and the description thereabout is briefly made or is entirely omitted.

Generally, a plurality of light emitting elements are formed on a large-sized mother substrate and then the mother substrate is cut along a cut line (S). The separated light emitting elements are used in the light emitting device. Therefore, as shown in FIG. 11, connection lines 273R, 273G, and 273B passing through the cut line (S) are additionally formed in consideration of the fact that the light emitting elements are cut based on the cut line (S).

In FIG. 11, the cut line (S) is an imaginary line, and the cut line (S) is positioned at each of four sides of the mother substrate.

The connection lines 273R, 273G, and 273B connect a first power pad 262 and a second dummy pad unit 270 emitting light of the same color. In other words, the connection lines 273R, 273G, and 273B connect the first power pads 262R, 262G, and 262B to the second dummy pad units 272R, 272G, and 272B, respectively. Accordingly, the connection of the first power pads 262R, 262G, and 262B and the second dummy pad units 272R, 272G, and 272B using the connection lines 273R, 273G, and 273B can prevent an increase in the number of pins of an external device during an aging process on subpixels 220 and monitor pixels 225.

After the aging process is performed, the mother substrate is cut along the cut line (S) during a cutting process for cutting the light emitting elements. Therefore, an electrical connection between the subpixels 220 and the monitor pixels 225 are naturally cut off, and the connection lines 273R, 273G, and 273B do no affect the light emitting device. In other words, the connection lines 273R, 273G, and 273B are used to perform the aging process on the subpixels 220 and the monitor pixels 225.

As described above, the light emitting device according to the exemplary embodiments can improve the display quality by uniformly performing the aging process on each subpixel.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A light emitting device, comprising:

a substrate;

a display unit on the substrate, the display unit including a plurality of subpixels;

a plurality of signal lines on the substrate, the signal lines including scan lines, power supply lines, and ground lines which are coupled to the plurality of subpixels;

a pad unit positioned at an edge of the substrate, the pad unit including a driver supplying driving signals to the signal lines, a first end, and a second end at a location opposing the first end; and first and second dummy pad units adjacent respective ones of the first and second ends of the pad unit and disposed in a non-overlapping relationship with the pad unit, wherein:

each of the first and second dummy pad units is coupled to signal lines included in the plurality of signal lines on the substrate, the first dummy pad unit applies first aging signals to subpixels coupled to a first set of the signal lines, and the second dummy pad unit applies second aging signals to subpixels coupled to a second set of the signal lines, each of the first and second aging signals changing a state of a transistor in a corresponding one of the subpixels.

2. The light emitting device of claim 1, further comprising a connection pad unit coupled to the pad unit through and to the first and second dummy pad units through corresponding one of the plurality of signal lines.

3. The light emitting device of claim 1, wherein:

each pixel in the display unit includes red, green and blue subpixels, each of the red, green, and blue subpixels is coupled to at least one of a transistor, capacitor, or light emitting diode, and at least one of the transistor, capacitor, or light emitting diode is coupled to one or more corresponding signal lines of the plurality of signal lines.

4. The light emitting device of claim 3, wherein each of the first and second aging signals turn on the transistors of corresponding ones of the red, green and blue subpixels.

5. The light emitting device of claim 4, wherein each of the first and second dummy pad units includes red, green, and blue power pads which are coupled to the red, green, and blue subpixels, respectively.

6. The light emitting device of claim 4, wherein:

each of the first and second dummy pad units includes an auxiliary pad coupled to a dummy pad, and a width of the signal lines coupled to the dummy pad is larger than a width of the signal line coupled to the auxiliary pad.

7. The light emitting device of claim 2, wherein:

the pad unit has substantially a square or rectangular shape, and the driver receives a driving signal from an external device coupled to the connection pad unit.

8. The light emitting device of claim 1, wherein a width of one or more of the signal lines is larger than a width of at least one of the first or second dummy pad units.

9. A light emitting device, comprising:

a substrate;

a display unit on the substrate, the display unit including a plurality of subpixels;

a plurality of monitor pixels positioned outside the display unit;

a plurality of signal lines on the substrate, the signal lines including scan lines, power supply lines, and ground lines which are coupled to the plurality of subpixels and the plurality of monitor pixels;

a pad unit positioned at an edge of the substrate, the pad unit including a driver supplying driving signals to the signal lines, a first end and a second end opposing the first end;

two first dummy pad units positioned adjacent respective ones of the first and second ends of the pad unit, each of the first dummy pad units being coupled to signal lines of the plurality of signal lines coupled to the subpixels and signal lines of the plurality of signal lines coupled to the monitor pixels; and a second dummy pad unit positioned between said two first dummy pad units and with the pad unit, and a third dummy pad unit coupled to signal lines coupled to monitor pixels, wherein each of the first dummy pad units applies an aging signal to at least one subpixel coupled to a corresponding one of the signal lines, each aging signal changing a state of a transistor in said at least one subpixel.

10. The light emitting device of claim 9, further comprising a connection pad unit coupled to the pad unit and the first two dummy pad units through corresponding one of the plurality of signal lines.

11. The light emitting device of claim 9, wherein:

each pixel in the display unit includes red, green and blue subpixels, each monitor pixel includes red, green and blue monitor subpixels, each subpixel and each monitor subpixel includes at least one transistor, capacitor or light emitting diode, and said at least one transistor, capacitor, or light emitting diode is coupled to one or more signal lines of the plurality of signal lines.

12. The light emitting device of claim 11, wherein the each of the two first dummy pad unit includes an auxiliary pad supplying the aging signals for turning on the transistors of the subpixels and the transistors of the monitor pixels, a first power pad supplying a first power to the subpixels, and a second power pad supplying a second power to the subpixels and the monitor pixels.

13. The light emitting device of claim 12, wherein the first power pad includes red, green, and blue power pads which are coupled to the red, green, and blue subpixels, respectively.

14. The light emitting device of claim 11, wherein the second dummy pad unit includes red, green, and blue monitor power pads which are coupled to the red, green, and blue monitor pixels, respectively.

15. The light emitting device of claim 11, further comprising:

a connection line connecting the first power pad and the second dummy pad unit that emits light of the same color as the first power pad, the connection line being formed to pass through a cut line of the substrate.

16. The light emitting device of claim 12, wherein the second dummy pad unit includes dummy pads positioned adjacent the first end and the second end of the pad unit and in an overlapping relationship with the pad unit.

17. The light emitting device of claim 9, wherein the power supply line connects the second dummy pad unit to the monitor pixels.

18. The light emitting device of claim 9, wherein the ground line connects the first dummy pad unit to the monitor pixels.

19. The light emitting device of claim 12, wherein a width of the signal line connected to the first and second power pads is larger than a width of the signal line connected to the auxiliary pad.

20. The light emitting device of claim 10, wherein the pad unit has a square or rectangular shape, and the driver receives a driving signal from an external device connected to the connection pad unit.

21. The light emitting device of claim 1, wherein the first aging signals correspond to a same signal and wherein the second aging signals correspond to a same signal.

22. The light emitting device of claim 21, wherein the first aging signals and the second aging signals correspond to a same signal.

23. The light emitting device of claim 1, wherein:

the first dummy pad unit includes a first pad to apply first power to the subpixels coupled to the first set of signal lines, and the second dummy pad unit includes a second pad to apply second power to the subpixels coupled to the second set of signal lines.

24. The light emitting device of claim 23, wherein the first power and the second power are substantially equal.

25. The light emitting device of claim 23, further comprising:

a first auxiliary pad coupled to supply the first aging signals to the first pad, and a second auxiliary pad coupled to supply the second aging signals to the second pad.

26. The light emitting device of claim 1, wherein the first and second dummy pad units are located on the same edge of the substrate at which the pad unit is positioned.

27. The light emitting device of claim 26, wherein the pad unit is located between the first and second dummy pad units.

* * * * *